US007213417B2

(12) United States Patent
Lonati et al.

(10) Patent No.: US 7,213,417 B2
(45) Date of Patent: May 8, 2007

(54) METHOD FOR PRODUCING INTARSIA DESIGNS WITH A CIRCULAR KNITTING MACHINE

(75) Inventors: Ettore Lonati, Brescia (IT); Fausto Lonati, Brescia (IT); Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 10/561,904

(22) PCT Filed: Jun. 22, 2004

(86) PCT No.: PCT/EP2004/006729

§ 371 (c)(1),
(2), (4) Date: Dec. 21, 2005

(87) PCT Pub. No.: WO2005/003419

PCT Pub. Date: Jan. 13, 2005

(65) Prior Publication Data

US 2006/0174661 A1 Aug. 10, 2006

(30) Foreign Application Priority Data

Jul. 3, 2003 (IT) ..... MI03A1367

(51) Int. Cl.
*D04B 9/00* (2006.01)

(52) U.S. Cl. ..... 66/8

(58) Field of Classification Search ..... 66/8, 66/11, 13, 16, 125 R
See application file for complete search history.

(56) References Cited

U.S. PATENT DOCUMENTS 4,709,563 A * 12/1987 Camiciotti et al. ..... 66/222
5,095,719 A * 3/1992 Philip ..... 66/8
6,722,163 B2 * 4/2004 Ando' ..... 66/51

FOREIGN PATENT DOCUMENTS

FR 2 249 198 A 5/1975
GB 1 559 675 A 1/1980

* cited by examiner

*Primary Examiner*—Danny Worrell
(74) *Attorney, Agent, or Firm*—Modino & Associati; Albert Josif; Daniel O'Byrne

(57) ABSTRACT

A method for producing intarsia designs with a circular knitting machine, which consists in correlating, for each row of knitting of the design to be produced, sets of needles, which are meant to reduce the regions (2,3,4,5) of the design in different colors or with different threads, with respective feeds or drops of the machine that dispense the corresponding threads, and in moving so as to knit the needles of each set of needles at the corresponding feed or drop by actuating the needle cylinder with an alternating rotary motion about its own axis, with an extent of oscillation that is sufficient to produce the transit of all the needles moved so as to knit of each set of needles at the corresponding feed, forming knitting both in the forward rotation and in the return rotation of the needle cylinder. At least the needles located at the ends of each set of needles are moved so as to knit both at the feed or drop that is correlated with the set of needles to which it belongs and at the feed that is correlated with the contiguous set of needles in order to join one another the various regions of the design.

2 Claims, 1 Drawing Sheet

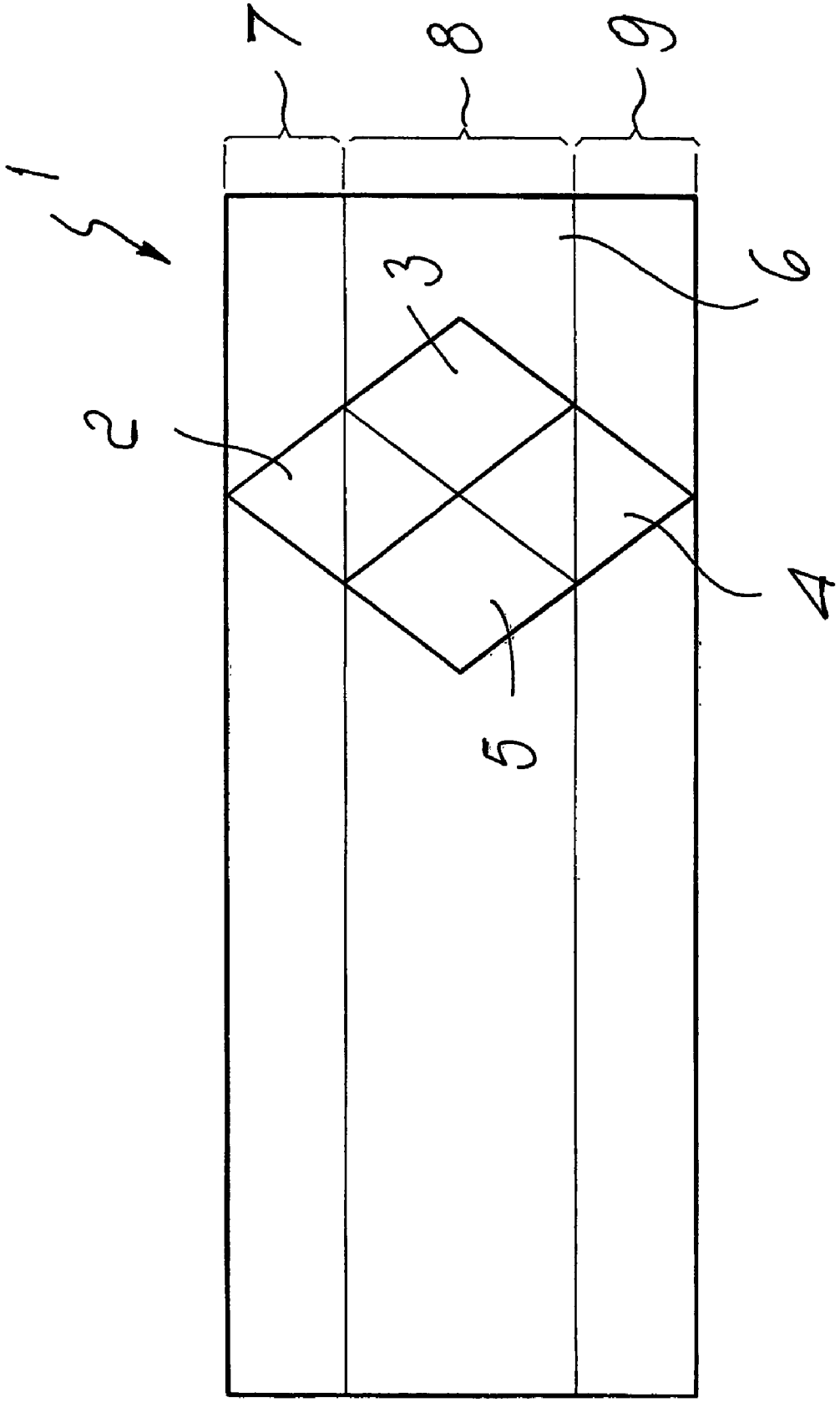
1
2
3
4
5
6
7
8
9

METHOD FOR PRODUCING INTARSIA DESIGNS WITH A CIRCULAR KNITTING MACHINE

TECHNICAL FIELD

The present invention relates to a method for providing intarsia designs with a circular knitting machine.

BACKGROUND ART

As is known, in the field of knitting, the expression "intarsia design" designates a design that is composed of regions of different colors or made with mutually different yarns that do not have floating threads on the reverse side, i.e., threads linking the regions on a same row of knitting provided by means of a same thread, and do not have thread cuts at the ends of each portion of row that composes a region of the design.

Intarsia designs are currently produced either with straight machines or with circular machines having a small diameter, i.e., circular hosiery knitting machines.

Rectilinear machines inherently have a distinctly lower productivity than circular machines, while small-diameter circular machines can be used almost exclusively to produce hosiery items.

With currently commercially available double-bed medium- and large-diameter circular machines it is possible to produce Jacquard designs, i.e., designs without floating threads, in which the inactive threads are tied on the reverse side of the knitted fabric. Jacquard designs lead to a different result with respect to intarsia designs both as regards the aesthetic appearance and as regards the structure of the fabric, which among other things is necessarily thicker.

DISCLOSURE OF THE INVENTION

The aim of the present invention is to provide a method that allows to produce intarsia designs with a medium- and large-diameter circular knitting machine.

Within this aim, an object of the invention is to provide a method that allows to produce articles with intarsia designs for forming items of clothing, such as for example body suits, sleeveless tops, bras, undershirts, underpants or the like, without lateral seams, with a circular knitting machine.

Another object of the invention is to provide a method that allows to produce articles with intarsia designs that have an excellent degree of finish.

This aim and these and other objects that will become better apparent hereinafter are achieved by a method for producing intarsia designs with a circular knitting machine, characterized in that it consists in correlating, for each row of knitting of the design to be produced, sets of needles, for producing the regions of the design in different colors or with different threads, with respective feeds or drops of the machine that dispense the corresponding threads, and in moving so as to knit each set of needles at the corresponding feed or drop by actuating the needle cylinder with an alternating rotary motion about its own axis, with an extent of oscillation that is sufficient to produce the transit of all the needles moved so as to knit of each set of needles at the corresponding feed, forming knitting both in the forward rotation and in the return rotation of the needle cylinder, at least the needles located at the ends of each set of needles being moved so as to knit both at the feed or drop that is correlated with the set of needles to which it belongs and at the feed that is correlated with the contiguous set of needles in order to mutually join the various regions of the design.

BRIEF DESCRIPTION OF THE DRAWINGS

Further characteristics and advantages will become better apparent from the description of a preferred but not exclusive embodiment of the method according to the invention, illustrated by way of non-limiting example in the accompanying drawings, wherein the only FIGURE is a view of a portion of a tubular article that is open circumferentially and is spread out on a plane with an intarsia design produced with the method according to the invention.

WAYS TO CARRYING OUT THE INVENTION

The portion of article, shown in the only FIGURE and generally designated by the reference numeral 1, may constitute a portion of an article for producing items of clothing such as body suits, sleeveless tops, bras, undershirts, underpants or the like, produced with a circular knitting machine in which the needle cylinder can be actuated with a rotary motion about its own axis in both directions of rotation, for example a machine of the type described in a co-pending Patent Application by the same Applicant.

The intarsia design shown in said FIGURE is composed of four regions 2, 3, 4, 5, in which the regions 2 and 4 are provided by means of the same color and/or thread and the other regions are provided by means of different colors and/or threads, for a total of four colors and/or threads including the color and/or thread of the background 6.

The example of design that is shown is merely an indication, since with the method according to the invention it is possible to provide designs having a contour that is different from the one shown and are composed of a larger or smaller number of colors or types or sizes of yarn, if an adequate number of feeds or drops is available on the machine being used.

In the illustrated case, the design can be provided by means of a machine with four feeds.

The method consists in correlating, for each row of knitting of the design to be produced, sets of needles, which are designed to produce the regions of the design in colors or with threads that differ from each other, with respective feeds or drops of the machine at which the corresponding threads are dispensed. In practice, the set of needles designed to knit the regions 2 and 4 is correlated with a first feed, the set of needles that is designed to knit the region 3 is correlated with a second feed, the set of needles that is designed to knit the region 5 is correlated with a third feed, and the set of needles that is designed to knit the background 6 is correlated with a fourth feed.

The needles of each set of needles are moved to knit at the corresponding feed, i.e., at the feed with which they are correlated, and the needle cylinder is actuated with an alternating rotary motion about its own axis with an extent of oscillation that is sufficient to produce the transit of all the needles that are moved to knit of each set of needles at the corresponding feed, forming knitting both during the forward rotation and during the return rotation of the needle cylinder. In this manner, the thread used to form a region of the design is never cut and does not float on the reverse side at the ends of the knitted row portion, but is cut exclusively when the corresponding design region is completed.

At least the needles that are located at the ends of each set of needles are moved to knit at the feed correlated with the set of needles to which they belong and at the feed that is correlated to the contiguous set of needles in order to join one another the various regions of the design.

The division of the needles into sets and therefore the correlation with a given feed of the machine is to be understood as being provided row by row of knitting, since on different rows of knitting a same set of needles may knit different regions of the design and therefore be correlated with one feed during the formation of one row and with other feeds during the formation of subsequent or previous rows of knitting.

For example, assuming that the portion 1 of the article is knitted by starting from the upper end, during the production of the rows of knitting of the first portion 7 the needles of the needle cylinder are divided into two sets, respectively a set that is designed to produce the region 2 of the design and is correlated with the first feed of the machine, and a set that is designed to produce the background 6 and is correlated with the fourth feed of the machine.

It should be noted that during the knitting of this first portion 7, at each forward rotation and at each return rotation of the needle cylinder about its own axis, i.e., in the formation of each row of knitting, in view of the configuration of the design that is shown, the number of needles that belong to the set that is correlated with the first feed is gradually increased by subtracting from the number of needles that belong to the set of needles correlated with the fourth feed.

During the production of the rows of knitting of the second portion 8, the needles of the needle cylinder are divided into four sets, respectively a set that is designed to produce the region 2 or the region 4 of the design and is correlated with the first feed of the machine, a set that is designed to produce the region 3 of the design and is correlated with the second feed of the machine, a set that is designed to produce the region 5 of the design and is correlated with the third feed of the machine, and a set that is designed to produce the background 6, which is correlated with the fourth feed of the machine.

During the knitting of this second portion 8, at each forward rotation and each return rotation of the needle cylinder about its own axis, i.e., in the formation of each row of knitting, in view of the configuration of the illustrated design, the number of needles that belong to the various sets is increased or decreased by subtracting from, or adding to, the number of needles that belong to the other sets.

During the production of the rows of knitting of the third portion 9, the needles of the needle cylinder are divided into two sets, respectively a set that is designed to produce the region 4 of the design and is correlated with the first feed of the machine and a set that is designed to produce the background 6 and is correlated with the fourth feed of the machine.

During the knitting of this third portion 9, at each forward rotation and each return rotation of the needle cylinder about its own axis, i.e., in the formation of each row of knitting, in view of the configuration of the illustrated design, the number of needles that belong to the set that is correlated with the first feed is gradually decreased in favor of the number of needles that belong to the set of needles that is correlated with the fourth feed.

It should be noted that the expressions "first feed", "second feed", et cetera are merely an indication and do not necessarily identify the sequence of the feeds encountered by the needles during the rotation of the needle cylinder about its own axis.

The sequence of the feeds of the machines that are correlated with the various sets is selected so as to minimize the possibility of interference between the knitting threads.

Optionally, the machine used to perform the method according to the invention may be equipped with thread takeup elements in order to avoid excessive loosening of the dispensed threads during reversal of the direction of rotation of the needle cylinder about its own axis.

In practice it has been found that the method according to the invention fully achieves the intended aim, since it allows to produce articles with intarsia designs with a medium- or large-diameter circular knitting machine with a degree of finish that is comparable with what can be obtained with rectilinear machines, but with a distinctly higher productivity.

The method thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2003A001367 from which this application claims priority are incorporated herein by reference.

What is claimed is:

1. A method for producing intarsia designs with a medium- or large-diameter circular knitting machine, consisting in the steps of:

correlating, for each row of knitting of the design to be produced, sets of needles, for producing the regions of the design in different colors or with different threads, with respective feeds or drops of the machine that dispense corresponding threads, and moving so as to knit each set of needles at the respective feed or drop by actuating the needle cylinder with an alternating rotary motion about its own axis, with an extent of oscillation that is sufficient to produce transit of all the needles moved so as to knit of each set of needles at the respective feed, forming knitting both in the forward rotation and in the return rotation of the needle cylinder, at least the needles located at the ends of each set of needles being moved so as to knit both at the feed or drop that is correlated with the set of needles to which it belongs and at the feed that is correlated with a contiguous set of needles in order to mutually join the various regions of the design.

2. The method according to claim 1, wherein the number of needles of each set of needles is changed row by row depending on a configuration of respective regions of the design to be provided.

* * * * *